US011673723B2

(12) United States Patent
Edwards

(10) Patent No.: US 11,673,723 B2
(45) Date of Patent: Jun. 13, 2023

(54) PULL BACK CLOSURE

(71) Applicant: Ourip Pty Ltd, Glenelg (AU)

(72) Inventor: Simon Edwards, Seaford Rise (AU)

(73) Assignee: Ourip Pty Ltd., Glenelg (AU)

( * ) Notice: Subject to any disclaimer, the term of this patent is extended or adjusted under 35 U.S.C. 154(b) by 0 days.

(21) Appl. No.: 17/055,767

(22) PCT Filed: May 16, 2019

(86) PCT No.: PCT/AU2019/050470

§ 371 (c)(1),
(2) Date: Nov. 16, 2020

(87) PCT Pub. No.: WO2019/218023

PCT Pub. Date: Nov. 21, 2019

(65) Prior Publication Data

US 2021/0206550 A1 Jul. 8, 2021

(30) Foreign Application Priority Data

May 17, 2018 (AU) ..... 2018901725

(51) Int. Cl.

| | |
|---|---|
| ***B65D 55/08*** | (2006.01) |
| ***B65D 41/32*** | (2006.01) |
| ***B65D 41/48*** | (2006.01) |

(52) U.S. Cl.

CPC ..... *B65D 55/08* (2013.01); *B65D 41/325* (2013.01); *B65D 41/485* (2013.01); *B65D 2401/30* (2020.05)

(58) Field of Classification Search

CPC .... B65D 55/08; B65D 55/0863; B65D 51/18; B65D 17/402; B65D 41/3409;

(Continued)

(56) References Cited

U.S. PATENT DOCUMENTS

| | | | |
|---|---|---|---|
| 2,684,778 | A | 7/1954 | Staller |
| 3,032,226 | A | 5/1962 | Terwilliger |

(Continued)

FOREIGN PATENT DOCUMENTS

| | | | |
|---|---|---|---|
| AU | 2002239883 | B2 | 7/2007 |
| BR | 0206557 | A2 | 4/2012 |

(Continued)

OTHER PUBLICATIONS

Supplemental Search Report of the EPO regarding application 19804486.9 from PCT/AU2019050470, dated Feb. 3, 2022, 7pgs.

*Primary Examiner* — Robert J Hicks
(74) *Attorney, Agent, or Firm* — Edwin A. Sisson, Attorney at Law, LLC; Jeffrey J. Banyas

(57) ABSTRACT

The invention described herein relates broadly to closure assemblies, and methods of use and manufacture thereof. More particularly, certain embodiments relate to assemblies and methods for closing an opening defined by a spout provided on a flexible container utilising a capping member having a plugging portion and a substantially fracturable retaining skirt. Embodiments provide may an adequate seal for the contents contained within bags against the significant pressure placed upon the closure by the often weighty and voluminous contents of the packaging. Furthermore, the closure may be easily and comfortably removable by a user whilst managing the handling of the bag.

10 Claims, 8 Drawing Sheets

(58) Field of Classification Search
CPC .... B65D 41/328; B65D 41/32; B65D 41/485; B65D 41/48; B65D 41/46
USPC ..... 215/256, 254, 253, 250, 228; 220/257.2, 220/257.1, 256.1, 270, 266, 265; 222/541.9, 541.6, 541.1
See application file for complete search history.

(56) References Cited

U.S. PATENT DOCUMENTS

| | | | | |
|---|---|---|---|---|
| 3,343,700 | A | 9/1967 | Heubl | |
| 3,438,533 | A * | 4/1969 | Neidl | B65D 17/12 220/270 |
| 4,318,490 | A * | 3/1982 | Schneider | B65D 41/32 156/69 |
| 6,305,437 | B1 | 10/2001 | Edwards | |
| D464,258 | S | 10/2002 | Edwards | |
| 6,695,757 | B2 | 2/2004 | Edwards | |
| 6,746,388 | B2 | 6/2004 | Edwards | |
| 6,783,277 | B2 | 8/2004 | Edwards | |
| 6,786,248 | B2 | 9/2004 | Johnson | |
| 6,889,482 | B2 | 5/2005 | Edwards | |
| 6,921,204 | B2 | 7/2005 | Edwards | |
| 7,025,220 | B2 | 4/2006 | Verespej | |
| 7,373,959 | B2 | 5/2008 | Edwards | |
| 8,177,083 | B2 | 5/2012 | Lamoureux et al. | |
| 8,556,124 | B2 | 10/2013 | Edwards | |
| 8,631,971 | B2 | 1/2014 | Edwards | |
| 8,672,184 | B2 | 3/2014 | Edwards | |
| 2002/0094922 | A1 | 7/2002 | Edwards | |
| 2002/0094923 | A1 | 7/2002 | Edwards | |
| 2002/0110291 | A1 | 8/2002 | Edwards | |
| 2003/0071237 | A1 | 4/2003 | Johnson | |
| 2004/0068957 | A1 | 4/2004 | Edwards | |
| 2004/0148910 | A1 | 8/2004 | Edwards | |
| 2005/0199313 | A1 | 9/2005 | Edwards | |
| 2005/0212291 | A1 | 9/2005 | Edwards | |
| 2007/0023383 | A1 | 2/2007 | Perrin et al. | |
| 2020/0115115 | A1 * | 4/2020 | Migas | B65D 55/16 |

FOREIGN PATENT DOCUMENTS

| | | | | |
|---|---|---|---|---|
| FR | 1123250 | A | 9/1956 | |
| JP | 2015187005 | A | 10/2015 | |
| WO | 1991/13813 | A1 | 9/1991 | |
| WO | 0192107 | A1 | 12/2001 | |
| WO | 0192109 | A1 | 12/2001 | |
| WO | 03022314 | A9 | 7/2003 | |
| WO | WO-2005058722 | A2 * | 6/2005 | B65D 47/088 |
| WO | 2010/131100 | A1 | 11/2010 | |
| WO | 2011044575 | A3 | 7/2011 | |
| WO | 2018129578 | A1 | 7/2018 | |

* cited by examiner

PULL BACK CLOSURE

PRIORITIES AND CROSS REFERENCES

This application claims priority from International Application No. PCT/AU2019/050470 filed on 16 May 2019 and Australian Application No. 2018901725 filed on 17 May 2018 the teachings of each of which are incorporated by reference herein in their entirety.

TECHNICAL FIELD

Various aspects of the invention described herein relate to a closure assembly, and methods of use and manufacture thereof. More particularly, certain embodiments relate to assemblies and methods for closing an opening defined by a spout provided on a flexible container utilising a capping member and a substantially fracturable retaining skirt.

BACKGROUND

For many years, "Bag-In-Box" flexible packaging has been widely adopted for the shipping of milk, egg, and shake or ice cream mix to restaurants. The most widely adopted packaging consists of a plastic bag or bladder containing a liquid or powdered product housed in some form of protective container, typically a corrugated box or plastic crate. "Bag-In-Box" packaging has also been adapted for combined liquid and powder mixtures whereby a single bag contains a powdered and a liquid product on either side of a breakable membrane divider. This system of manufacture allows the manufacturer to concentrate large volumes of product, and package the product for ease of transport and convenience to retailers who can dispense or prepare the product directly from the manufacturer's packaging without the need for additional handling.

The most widely adopted closure of flexible packaging to contain the product within the bag following manufacture of the product and filling of the bag, comprises a spout closed by a sealed cap. A wide variety of caps are available and are adopted for this purpose, including screw caps which can be screwed off the spout fitting, peel-off caps which can be peeled back from the spout or bag, or plugging caps which must be forcibly pulled out of the spout. Closure types are typically selected for their suitability to contain the material within the bag, or for their ability to meet the specific requirements of filling or dispensing equipment. No single closure is known to be suitable for dispensing all products or for use with all filling or dispensing equipment or connectors.

Manufacturers of "Bag-In-Box" products typically manufacture the product with a view that it will be further prepared, finished or directly dispensed by a restaurant or retailer, using specialized equipment adapted for such purposes. For instance, ice cream mix is prepared by manufacturers to be introduced into specialised equipment that holds the product with other constituents, combines the mixture, freezes the mixture and dispenses the finished product for consumption; whereas egg products are prepared to be introduced into specialised equipment that will hold, combine and heat or cook the product prior to and dispensing the finished product.

Before the contents of the bag can be introduced into machinery for preparation, typically a hopper of some kind, users must remove the cap by hand or with the use of a tool. Often, users will remove the bag from its protective box or other container and hold the bag in proximity of the hopper or other vessel into which the product is to be dispensed. The cap is then removed, and the contents are poured into the vessel by hand.

However, caps found on "Bag-In-Box" packaging of this kind are often difficult to remove, and the user must remove the cap while maintaining the bag in an upright position to prevent spillage of the product. The user must maintain a grip of the bag, typically at the spout, bear the weight of the contents of the bag in an upright position while carefully removing the cap. As the cap must withstand the pressure of the product upon it to prevent leakage of the product, the cap requires some force to unscrew, peel back or pull out of the spout. Users frequently have trouble applying the required force while maintaining and balancing the bag. Many caps require that the user use two hands to release the cap, to hold the spout while unscrewing, peeling back or pulling out the cap, leaving the user unable to hold and manage the bag filled with product. Such difficulties in removing the cap may force many users to resort to the burdensome use of a tool (if one is by chance available).

In anticipation of the difficulties in maintaining the bag while removing the cap, users will often remove the cap above the hopper, so that the contents of the bag spill over into the hopper once the cap is removed. Such difficulties in removing the cap typically result in the user accidentally dropping the cap or the cap removal tool into the hopper with the product. In most cases, particularly for the packaging of foodstuff, the contamination arising from these incidents requires the product to be discarded altogether. Alternatively, difficulty in removing the cap with a single hand while balancing the bag in the other may result in the user dropping the bag or other container upon which the cap is mounted. This may well result in the spillage of the contents of the container or damage to the container.

Attempts to provide alternative closures for such commercial applications have been challenging to conceive and develop. Some manufacturers have taken the decision to abandon "Bag-In-Box" packaging altogether in preference to hardened disposable polyethylene containers, which are more costly and inefficient to distribute. These manufacturers have chosen to forgo cost, efficiency and environmental benefits of "Bag-In-Box" packaging to mitigate the challenges brought about by the inadequacies of present day closures.

Suitable closures must be capable of providing an adequate seal for the contents contained within bags against the significant pressure placed upon the closure by the often weighty and voluminous contents of the packaging. Furthermore, the closure must be easily and comfortably removable by a user whilst managing the handling of the bag.

SUMMARY OF INVENTION

A first aspect of the invention relates to a closure assembly for closing an opening defined by a spout provided on a flexible container comprising, a capping member for covering the opening and further comprising a plugging portion extending outwardly at its outermost periphery forming a surface for the attachment of a substantially fracturable retaining skirt, the substantially fracturable retaining skirt being disposed about at least a portion of the periphery of the plugging portion and being attached to and projecting substantially perpendicularly from the surface and substantially parallel with the lengthwise orientation of the plugging portion, and the substantially fracturable retaining skirt comprising a tear end and an attachment end at opposing ends of the retaining skirt, the tear end having a grip means attached thereto and a weakening at the area of attachment of the substantially fracturable retaining skirt to the plugging portion surface, and the attachment end having a substantially secure attachment at the area of attachment of the substantially fracturable retaining skirt to the plugging portion surface; wherein the substantially fracturable retaining skirt is configured to be fracturable upon application of force from the grip means away from the plugging portion but the attachment end of the retaining skirt is configured to be non-fracturable and the application of force at the attachment end may aid the release of the plugging portion.

The term "fracturable" and derivative or related terms such as "fractured" and "fracturing" as used herein are to be understood to be included within their meaning, but are not to be understood to be limited to, a quality of feature or article that enhances its ability to be broken, torn, snapped etcetera. For example, amendments to a feature or article that render it "fracturable" may include the incorporation of perforations within a material, or a change in the thickness or density (or other form of weakening) of a material, or similar.

The plugging portion may be formed in any one of a number of shapes, including a cylindrical or tapered portion projecting into the spout. A suitable conformation of the plugging portion will involve a conformation that will plug or reduce the flow of fluid from the closure assembly. In certain embodiments, the closure assembly of the first aspect may include a plugging portion that is curved about a substantially central axis.

Indeed, the capping member of such a closure assembly may be configured to comprise a hollow semi dome shaped plugging portion, the convexity of the plugging portion extending downwardly, and a substantially annular projection extending outwardly from the edge of the hollow semi dome shaped plugging portion to provide the surface for the attachment of a substantially fracturable retaining skirt.

In preferred embodiments of the first aspect, the plugging portion of the closure assembly is configured to abut against an inner wall of the spout defining an opening on a flexible container to plug the opening and substantially enclose the contents of the flexible container therein.

In certain embodiments, the plugging portion may be provided with a bottom surface that is a substantially convex in shape. The shape of the plugging portion may be formed to substantially fill the opening of a container, thereby effectively "plugging" the opening. This "plugging" effect may render the cap more resistant to leakages. It may further provide a greater tolerance to the weight and pressure of the contents of the container against it, by virtue of both the improved grip of the cap on the container opening when forming an effective plug, as well as the curved shape of the plugging portion which provides greater mechanical strength.

Curved structures have physical properties able withstand greater force than equivalent planar structures. This principle of physics, employed in the plugging portion of the closure assembly, provides a significant improvement to the capping member which is capable of withstanding greater pressures from the contents of the materials contained within the flexible packaging than a planar plugging portion. Thus, the capping member may be used with larger packaging or to contain heavier materials.

Additionally, the curvature of the plugging portion improves the sealing or containing properties of the capping member, as the outer surface of the plugging portion forms a closer fit within the opening of the spout. As resistance is maintained by the plugging portion material against the inner surface of the spout opening, leakage of the material contained within the flexible container is reduced, in comparison with a typical cap.

The convex arrangement may allow the plug to withstanding substantial force resulting from the volume of content and impacts on the packaging. Such convex structures, in turn, allows the closure to withstand greater forces. In general, such convex structure provides for an external and internal conformation that provides greater mechanical strength.

The annular projection of the first aspect may form a cap collar. The cap collar may comprise at least one securement ridge configured to secure the closure assembly to a spout retaining collar. The cap collar may further comprise a connecting flange, connected to the plugging portion; and/or a retaining skirt, connected to the connecting flange. The connecting flange may further extend substantially horizontally from the outer periphery of the plugging portion, and the retaining skirt may extend downwardly from the connecting flange.

In certain embodiments, the closure assembly of the first aspect may comprise a substantially fracturable retaining skirt further comprising a substantially annular securement means configured to grip at least a portion of the exterior surface of the spout defining an opening on a flexible container. The securement means may comprise one or more annular ridges projecting inwardly from the substantially fracturable retaining skirt to abut against at least a portion of the exterior surface of the spout defining an opening on a flexible container, or grip at least a portion of a lip provided on the exterior surface of the spout.

The retaining skirt may be configured to be retained upon the spout any number of ways which include the presence of a fastener coupling, such as a hook, ridge, snap lock or similar fitting present on the retaining skirt. Alternatively, the retaining skirt may be retained upon the spout by other forms of physical securement such as heat shrinking the skirt upon the spout.

The closure assembly of the first aspect may be embodied such that the attachment of the substantially fracturable retaining skirt to the plugging portion surface is weakened by a reduction in the thickness of a material forming the closure assembly at the area of attachment of the substantially fracturable retaining skirt to the plugging portion surface; but not at the area of attachment of the attachment end of the retaining skirt. The area of attachment of the substantially fracturable retaining skirt to the plugging portion surface may further comprise a notch at the tear end to aid the tearing of the retaining skirt and unplugging of the plugging portion.

The notch together with the retaining skirt may provide assurance to the user that the spout has not been exposed, tampered with or otherwise soiled so as to pose a hygiene risk. The notch may further enable the user to readily remove the closure assembly by providing purchase for the user to continue tearing the weakened or fracturable portion of the retaining skirt while pulling on the grip means. Such configurations may aid the user in removing the closure assembly by reducing the force required to remove the cap and/or only requiring the use of a single hand to remove the closure assembly.

In one form, closure assemblies of the first aspect may disengage at least a portion of the cap collar from the spout retaining collar which is associated with tearing at least a portion of the closure assembly along at least one weakened portion. The weakened portion may further include an annular line of weakness that extends about at least a portion of the plugging portion; the annular line of weakness may, in turn, demarcate the connecting flange from the retaining skirt.

The grip means of certain embodiments of the first aspect may comprise a hook or annular ring to aid the gripping of the grip means by a user and the application of force on the grip means away from the plugging portion by the user. The grip means may be an annular ring attached to the tear end of the substantially fracturable retaining skirt extending outwardly from the retaining skirt.

The grip means of the first aspect may comprise a pull-tab, wherein the pull-tab assembly may be connected to the cap collar. The pull-tab may be movable from a stowed position, disposed interior of the cap collar, to a deployed position, disposed outside of the cap collar. The pull-tab in the deployed position may enable a user to apply pull force so as to disengage at least a portion of the cap collar from the spout retaining collar of the spout.

The pull-tap may comprise a loop portion, which embodies the form of a substantially annular ring. The loop portion may enable the user to grip the pull-tab assembly and move the assembly as described above. The loop portion may be sized to accept one or two fingers within the loop for gripping the pull-tab. As such, the user may gain significant control of the direction and/or force applied to the movement of the pull-tab assembly.

A pull-tab may therefore be provided that is easily grasped and pulled. Relatedly, the pull-tab may be disposed in a stowed position so as to be received within the cap. This is also in contrast to existing products that do not have an annular ring as they are designed to be tamperproof. However, the present cap, with the stowed arrangement, provides a balance between ease of use and tamper proofing.

Further, the user may maintain control of the closure assembly during its removal and once it has been removed by hooking one or two fingers within the loop portion. This may reduce the likelihood of a flexible liquid bag being damaged or dropped and/or may reduce the likelihood of the cap being dropped or lost during removal.

The tearing of closure assemblies may include tearing along a vertical line of weakness that demarcates a weakened portion of the retaining skirt. The weakened portion of the retaining skirt may define a retaining skirt tear end and a retaining skirt attachment end.

Alternatively, tearing may comprise tearing along a line of weakness that demarcates a weakened portion of the connecting flange. Furthermore, the weakened portion of the connecting flange may be constituted by a connecting flange tear segment, wherein the pull-tab assembly may be connected to the cap collar at the connecting flange tear segment.

The connecting flange may further include a connecting flange tear segment extending along an annular portion of the connecting flange, and the pull-tab assembly connected to the cap collar at the connecting flange tear segment.

In certain embodiments, the pull-tab assembly may include a connecting tang, disposed between the pull-tab and the cap collar, that includes a hinge for pivoting of the pull-tab from the stowed position to the deployed position; and the connecting flange tear segment providing a channel to accept a length of the tang when the pull-tab is in the stowed position.

The pull-tab assembly may also include a connecting tang, disposed between the pull-tab and the cap collar, that includes a hinge for pivoting of the pull-tab from the stowed position to the deployed position. The tang may include a first end and a second end, wherein the first end of the tang may be connected to the cap collar, and the second end of the tang may be connected to the pull-tab.

In certain embodiments, the hinge may be constituted by a plastic member provided with a weakened line, so as to allow pivoting about the weakened line. Alternatively, the hinge may be formed by joining two pieces with a pin providing a hinge point about which one piece pivots with respect to the other. Furthermore, the pull-tab, in the deployed position, may further provide for a user to apply the pull force so as to disengage at least a portion of the cap collar from the plugging portion.

In addition to bag and boxes, the closure assembly of the first aspect may be used with a wide variety of products including 2 L and 4 L PET style bottles, such as for milk or orange juice, for example. As described above, tear off caps are currently available commercially. However, these tear off caps are unsuitable for withstanding the pressure and force of the contents of the container. Many are designed as tamper proof closures for food products, and many are indeed prone to leaking.

Therefore, substantial force may be required to remove the plug member. Thus, in accordance with one aspect, a pull-tab is provided that may be pulled down to tear the weakened portion, thus allowing the application of additional force. This arrangement is in contrast with many alternative arrangements in which a pull-tab is located on a side of the cap and not conducive to varied angles of pull force.

The closure assembly may also be provided in combination with a container that includes a spout. The container may, further, take the form of a bag.

The skirt of the cap may provide a primary mechanism that locks the cap onto the spout. The locking system may provide evidence of tampering when broken, so as to render the closure assembly tamper evident. A pull-tab facilitates the removal of the skirt, from the cap, along one or more deliberate lines of weakness, thereby freeing the cap.

A closure assembly according to the first aspect may be constructed of a more substantial material than those that are known in the field. The reason is that greater force may be exerted so as to disengage a cap by having more substantial material. It my be desirable for certain manufacturers to use a more substantial material to contain larger volumes of material within the flexible container, or to contain heavier materials.

The present closure assembly also provides an innovative arrangement of lines of weakness, and thus the closure assembly may be constructed of more substantial material. As a result, the present closure assembly resists leakage even when substantial force is applied. As a result, the cap may be provided to withstand significant hydraulic force.

Closure assemblies may be manufactured or constructed by moulding from a plastic or plastic composite material and forming a weakening between the substantially fracturable retaining skirt and the plugging portion surface by moulding the weakening into the closure assembly, by cutting the weakening into the closure assembly or by stamping the weakening into the moulded closure assembly.

Closure assemblies of the first aspect may be employed in methods for closing openings defined by a spout provided on a flexible container, many of which are of standard sizes and configurations, comprising positioning the plugging portion of a closure assembly over the opening and engaging the retaining skirt about at least a portion of the exterior surface of the spout.

Further, the present closure assembly provides for a substantial variety of uses. The closure assembly is capable of withstanding substantial volumes. The field of use of the cap of the disclosure may be applied to retail hoppers, retail tanks or manufacturing hoppers, for example. They might include ice cream hoppers for fast food service, bag and box packaging, manufacturing of foods such as with egg or egg substitute products, for example. Additionally, the closure assembly provides a structure to withstand the weight of volume held within a bag or package, to which the cap of the disclosure is provided, as well as to withstand impacts on the bag or packaging, such as resulting from droppage.

Various further aspects and features of the disclosure are described below.

BRIEF DESCRIPTION OF THE FIGURES

The invention now will be described with reference to the accompanying drawings together with examples and the preferred embodiments disclosed in the detailed description. The invention may be embodied in many different forms and should not be construed as limited to the embodiments described herein. These embodiments are provided by way of illustration only such that this disclosure will be thorough, complete and will convey the full scope and breadth of the invention.

DETAILED DESCRIPTION OF EMBODIMENTS

Several embodiments are described in detail below with reference to the figures. Exemplary embodiments are described to illustrate certain aspects and embodiments of the invention, not to limit its scope, which is defined by the claims. Those of ordinary skill in the art will recognise that a number of equivalent variations of the various features provided in the description that follows may be possible.

Figure 1:
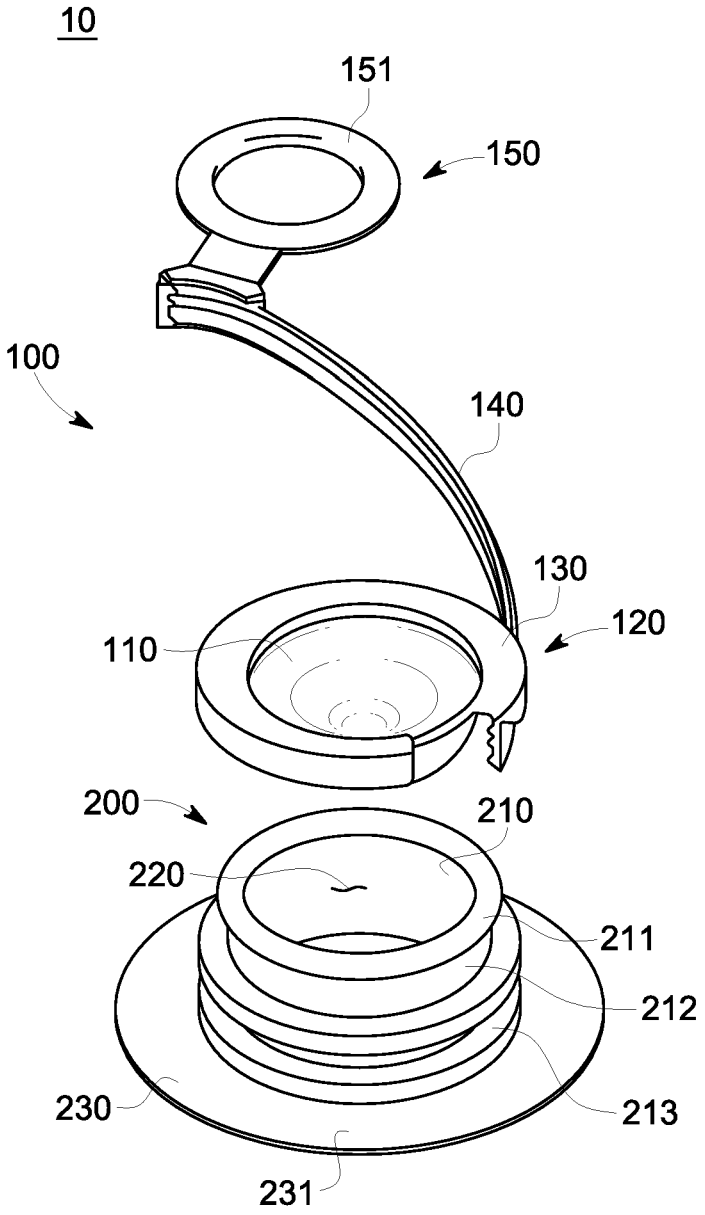
FIG. 1 is a perspective view of a closure assembly, in accordance with at least one embodiment of the invention.
Figure 2:
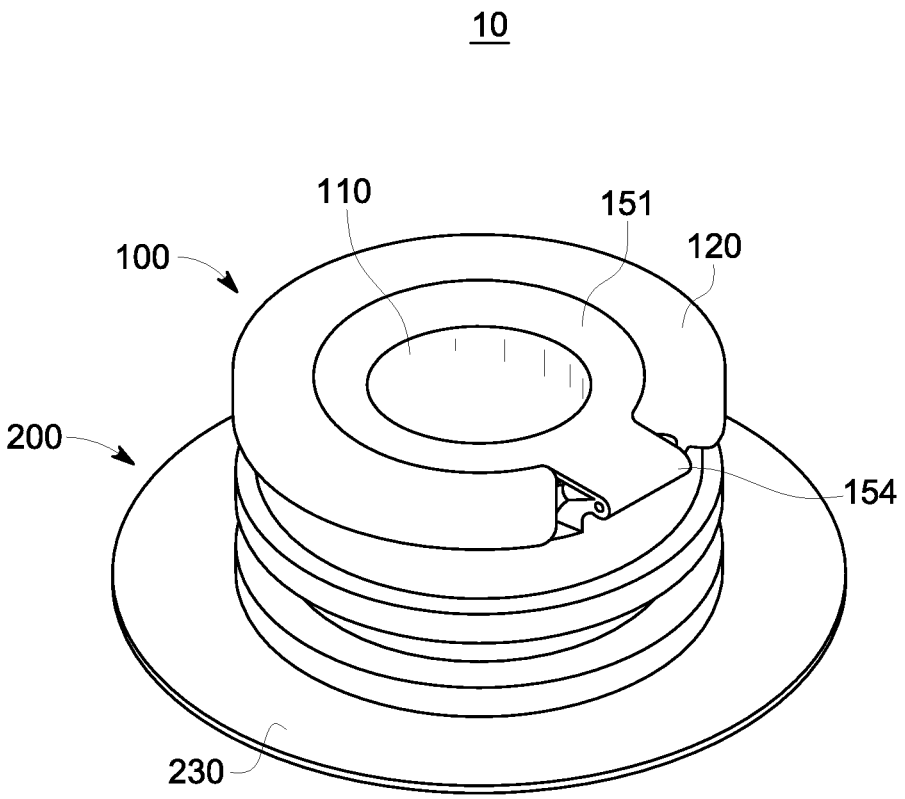
FIG. 2 is a perspective diagram of the closure assembly disposed upon, and connected to, a container spout.

FIG. 1 provides a perspective view of a closure assembly 10, in accordance with at least one embodiment of the invention. The closure assembly 10 includes a cap, herein characterised as a closure assembly 100, and a spout 200. As shown in FIG. 1, the closure assembly 100 has been removed from the spout 200, and the disposition of the spout 200 is open to allow fluid, for example, to pass out of the spout, in accord with aspects of the disclosure as described below. In contrast to FIG. 1, FIG. 2 is a perspective diagram of the closure assembly 100 disposed upon, and connected to, the spout 200. In the arrangement of FIG. 2, the disposition of the spout 200 is closed.

The closure assembly 100 includes a plugging portion 110. In the arrangement of FIG. 2, the plugging portion 110 is secured upon the spout so as to close spout opening 220. The plugging portion 110 may be secured to the spout 200 with a cap collar 120. On the other hand, in the arrangement of FIG. 1, the plugging portion 110 is removed from the spout 200 so as to open spout opening 220.

Figure 3:
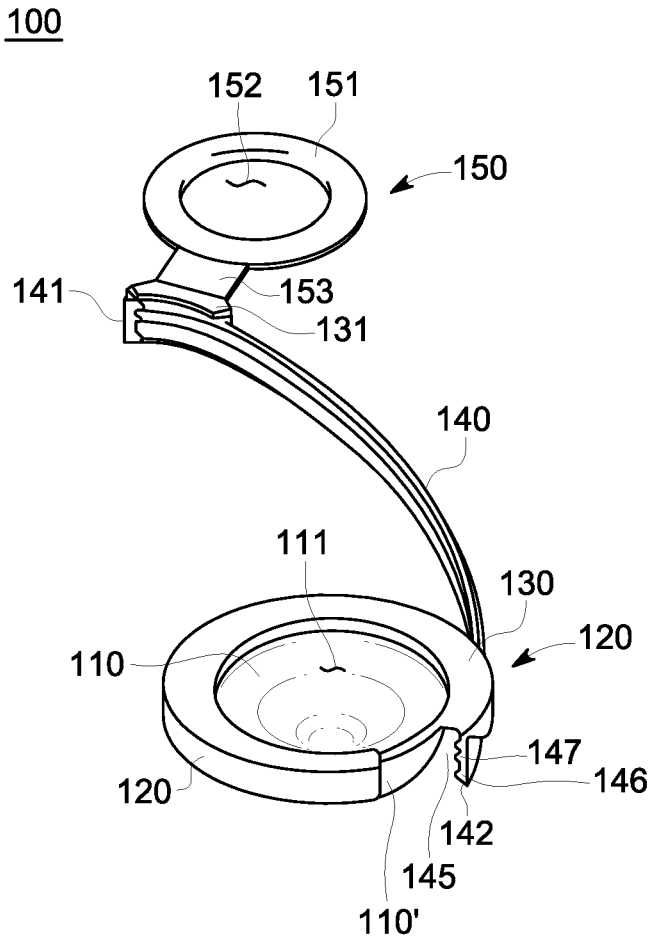
FIG. 3 is a perspective view of the closure assembly of FIG. 1, in accordance with at least one embodiment of the invention.

FIG. 3 provides a perspective view of the closure assembly 100 of FIG. 1, in accordance with at least one embodiment of the disclosure. Hereinafter further details will be described with reference to FIG. 2, as well as FIGS. 1 and 3.

A closure assembly 10, in accordance with at least one embodiment, includes a plugging portion 110, a cap collar 120, and a pull assembly 150. As is shown in FIG. 3, the cap collar 120 extends around an outer periphery of the plugging portion 110. The cap collar 120 includes both a connecting flange 130 and a retaining skirt 140. The connecting flange 130 may be connected to an outer periphery of the plugging portion 110. From the outer periphery of the plugging portion 110, the connecting flange 130 may extend in a substantially horizontal manner. The retaining skirt 140 may be connected to the connecting flange 130. More specifically, the retaining skirt 140 may extend downwardly, in an annular manner, from the connecting flange 130. In some embodiments, the retaining skirt 140 may be disposed adjacent or proximate to an outer periphery of the connecting flange 130. However, in other embodiments, the retaining skirt 140 may be disposed at a distance from an outer periphery of the connecting flange 130, in the manner shown in FIG. 3.

The plugging portion 110 may be provided with a bottom surface 110' that is convex or bowed to a degree. The convex arrangement may offer the advantage of withstanding substantial force resulting from the volume of content pressing against the plugging portion 110, as well as withstanding impacts on the packaging. The convex structure, in turn, allows the closure to withstand higher forces placed upon the closure than is currently provided by closures commonly available for other fields of use e.g. those used in milk and juice packaging. In general, such convex structure of the plugging portion 110 provides for external and internal conformation that provides greater mechanical strength.

The retaining skirt 140 may be provided with a plurality of ridges 145. In particular, as shown in FIG. 3, the ridges 145 may include upper securement ridges 147 and lower securement ridges 146. The ridges 145 serve to secure the closure assembly 100 upon spout 200. More specifically, the ridges 145 serve to engage with a spout retaining collar 211, as shown in FIG. 1.

As shown in FIG. 1, the spout 200 includes a supporting stem or tube 210. The supporting stem 210 may be in the form of a short tubular structure that is provided with a spout opening 220. Accordingly, fluids, for example, may pass through the spout opening 220. The spout retaining collar 211 may be provided proximate an upper end of the supporting stem 210. The spout retaining collar 211 engages one or more of the ridges 145 so as to secure the closure assembly 100 upon the spout 200. However, it is appreciated that any number of spout retaining collars 211 and/or alternatives to ridges 145 may be provided as desired. For example, the spout retaining collar 211 may be constituted by a plurality of ridges and the ridges 145 may be constituted by a single ridge.

As shown in FIG. 1, the spout 200 also includes a skirt channel 212. The skirt channel 212 may provide an annular channel that accepts one or more of the ridges 145. Accordingly, the spout retaining collar 211 and skirt channel 212 collectively afford a securement mechanism so as to engage with ridges 145. The skirt channel 212 may be formed, in part, by an outer surface of the supporting stem 210.

The spout 200 may further include ribbed surface disposed upon the supporting stem 210. The ribbed surface 213 may be provided for structural support and/or provided to attach a tube, pipe, or to attach to another structure upon the spout after the closure assembly has been removed. They may also be provided for additional support and improved grip strength at the point of attachment, for example, when fitted to a box or dispenser. As a result, the attached tube or pipe may then direct fluid exiting the spout opening 220 in a desired manner. Alternatively, the ribbed surface 213 may be constituted by threads or a threaded arrangement upon which a tube, pipe, or other structure may be disposed upon the spout 200; so as to direct fluid exiting from the spout opening 220. Additionally, the spout 200 may be provided with a spout securement collar 230. The spout securement collar 230, for example, may be attached to an interior surface of a container or bag to which the spout 200 is provided. For example, an upper surface 231 of the spout securement collar 230 may be secured to an internal surface of a supporting bag, so as to support the spout 200. The spout securement collar 230 may be secured to such an internal surface of a supporting bag utilising adhesive, heat bonding, and/or other arrangement. Alternatively, a lower surface of the spout securement collar 230 may be secured to an external surface of a supporting bag, so as to support the spout 200.

In an aspect of the disclosure, the closure assembly may be secured upon the spout 200 as shown in FIG. 2, and yet be easily removable to open the spout opening 220 to provide the arrangement shown in FIG. 1. The closure assembly 100 is provided with a pull-tab assembly 150 in accordance with at least one embodiment of the disclosure. The pull-tab assembly may include a pull-tab 151 that includes a pull-tab opening 152. The pull-tab 151, in embodiments of the disclosure, is connected to the cap collar 120 via a connecting tang 153.

In general, the closure assembly 100 and/or the spout 200 may be constructed in whole or in part of a suitable plastic material and/or other material, as may be desired. Suitable materials and their comparative qualities and characteristics are known to persons skilled in the art, who may select a material based on its desired performance qualities in the field of application.

More specifically, the connecting tang 153 is connected to a connecting flange tear segment 131, which constitutes a part of connecting flange 130. The connecting flange tear segment 131 is in turn connected to a retaining skirt first end 141. In operation, as described further below, the pull-tab 151 is movable from a stowed position to a deployed position. In the stowed position, the pull-tab 151 is disposed interior of the cap collar 120. This arrangement is shown in FIG. 2. In particular, the pull-tab 151 may be disposed and/or at least partially contained within a cap recess 111 of the plugging portion 110. As shown in FIG. 3, the cap recess 111 may be constituted by a recess, indent or divot formed in the plugging portion 110. On the other hand, in the "deployed" position the pull-tab 151 is disposed outside of the cap collar 120. This arrangement provides an advantage of being highly contained and sleek as shown in FIG. 2. On the other hand, as described below and FIG. 3, the deployed position of the pull-tab 151 allows a user to exert substantial pull force, in various directions, so as to easily and effectively tear the retaining skirt 140 from the connecting flange 130 along one or more predetermined weakened lines. In other words, the pull-tab 151, in the deployed position, enables a user to apply a substantial pull force so as to disengage at least a portion of the cap collar 120 from the spout retaining collar 211 (FIG. 1) of the spout 200. As a result, the closure assembly 100 may be removed from the spout 200.

Such disengagement of at least a portion of the cap collar 120 from the spout retaining collar 211 (of the spout 200) may be associated with tearing at least a portion of the closure assembly 100. In particular, as described herein, such tearing of the closure assembly 100 may be performed as a result of a pull force applied by the user, to the pull-tab 151, as applied to one or more weakened lines or lines of weakness in the closure assembly.

Figure 4:
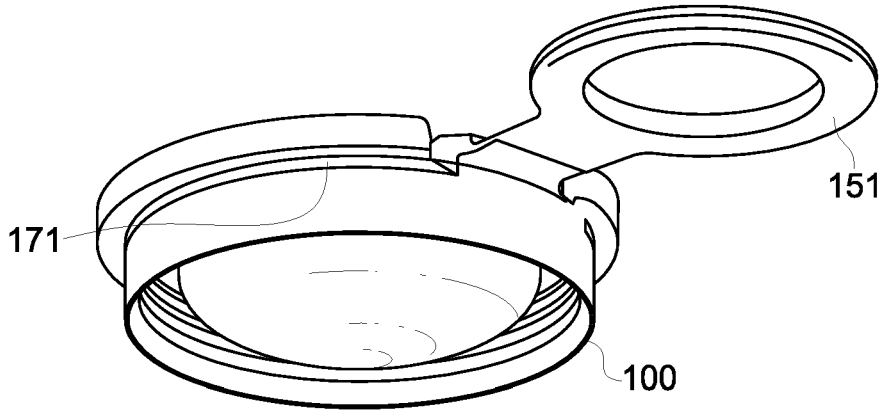
FIG. 4 is a perspective view of a closure assembly showing lines of weakness, in accordance with at least one embodiment of the invention.
Figure 5:
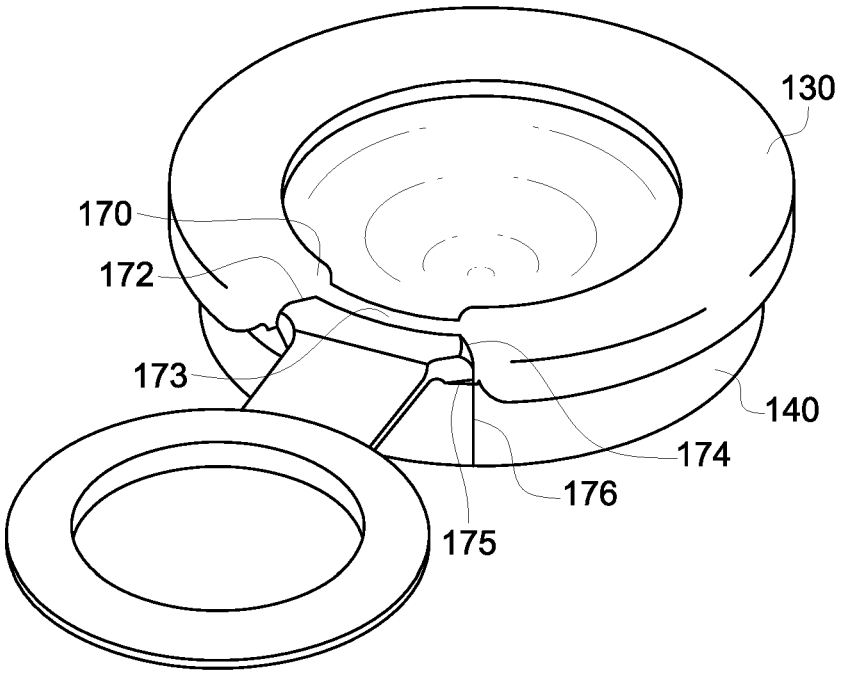
FIG. 5 is a further perspective view of a closure assembly showing lines of weakness, in accordance with at least one embodiment of the invention.

FIG. 4 is a perspective view of a closure assembly 100 showing a portion of a series lines of weakness 170, in accordance with at least one embodiment of the invention FIG. 5 is a perspective view of a closure assembly 100 showing a portion of lines of weakness', in accordance with at least one embodiment of the invention.

In particular, a weakened portion in the closure assembly 100 as shown in FIG. 4 may include an annular line of weakness 171 that extends around the plugging portion 110. The annular line of weakness is provided to demarcate the connecting flange 130 from the retaining skirt 140 shown in FIG. 5 and provides a separation point for the retaining skirt 140 to be separated from at least a portion of the connecting flange 130. The annular line of weakness 171 is shown in FIG. 4.

As described above, an annular line of weakness 171 is provided to demarcate the connecting flange 130 from the retaining skirt 140. The annular line of weakness 171 provides a separation point or line for the retaining skirt 140 to be separated from at least a portion of the connecting flange 130.

Tearing of the closure assembly 100 may also include tearing along a vertical line of weakness 176 (as shown in FIG. 5) that demarcates a weakened portion of the retaining skirt. Specifically, the weakened portion of the retaining skirt may be a line of weakness 176 that demarcates a retaining skirt first end 141 and a retaining skirt second end 142 (as shown in FIG. 3).

Further, tearing of the retaining skirt 140 from the connecting flange 130 may be associated with tearing along one or more lines of weakness 172, 173, 174 that serve to provide a separation between the connecting flange tear segment 131 from a remaining portion of the connecting flange 130. Further details are described below relating to the manner in which the closure assembly 100 is removed from the spout 200 utilising various lines of weakness.

As shown in FIG. 3, for example, the pull-tab assembly includes a connecting tang 153. The connecting tang 153 may be provided between the pull-tab and the cap collar 120. More specifically, the connecting tang 153 may include a first end and a second end. A first end of the connecting tang 153 may be connected to the pull-tab 151. On the other hand, a second end of the connecting tang 153 may be connected to the connecting flange tear segment 131. As a result, pull force exerted upon the pull-tab 151 may be transferred through the connecting tang 153 so as to exert force on the connecting flange tear segment 131. Such arrangement provides the ability to exert force on tear lines 172, 173, 174, 176. In particular, the arrangement provides the ability to initially exert a tear force on a tear initiation point 175, as shown in FIG. 5, for example.

The connecting tang 153 also provides a hinge 154 (shown in FIG. 2), in accordance with one embodiment of the invention, to provide for pivoting of the pull-tab 151 from a stowed position to a deployed position. The hinge may be constituted by a plastic member or other flexible member that is adapted to bend. The connecting tang 153 may be provided with a weakened portion in a midportion thereof, i.e. where bending is desired, so as to enhance the bendability of the connecting tang 153. As shown in FIG. 3, the connecting tang 153 may be constituted by a planar material, such as plastic.

Figure 6:
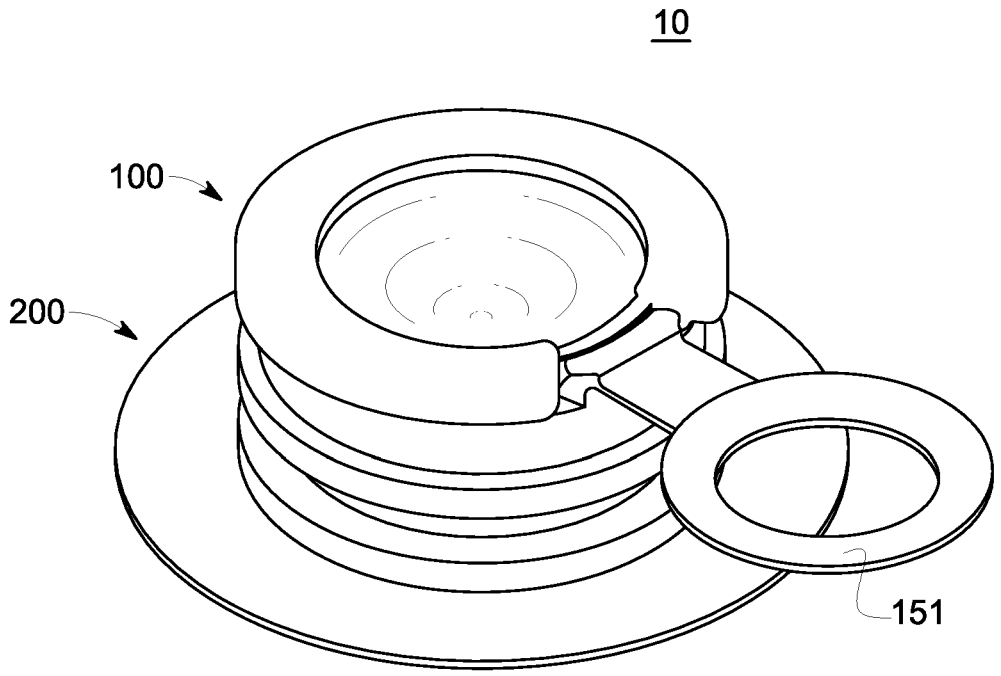
FIG. 6 is a perspective view of a closure assembly, with pull-tab in a deployed position, secured upon spout 200, in accordance with at least one embodiment of the invention.

As is also described above, FIG. 3 is a perspective view of a closure assembly 100, with pull-tab 151 in a stowed position, secured upon spout 200 to close the spout, in accordance with at least one embodiment of the invention. FIG. 6 is a perspective view of a closure assembly 100, with pull-tab 151 in a deployed position, secured upon spout 200, in accordance with at least one embodiment of the invention.

Figure 7:
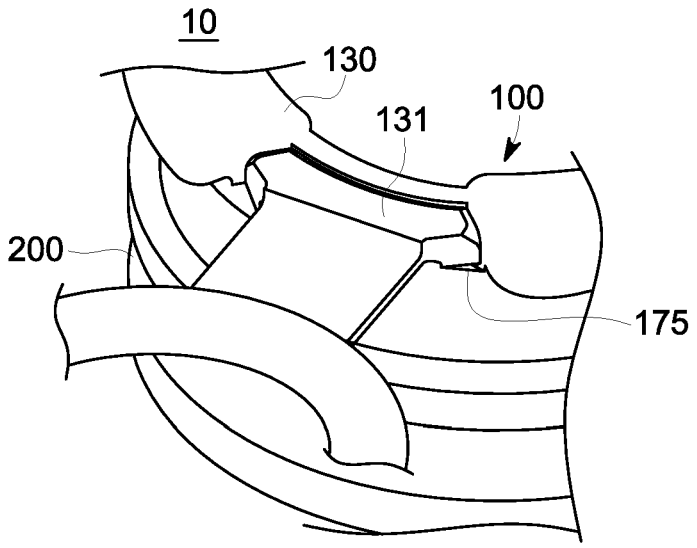
FIG. 7 is a perspective view of a portion of the closure assembly showing a tear initiation point in the cap collar.
Figure 8:
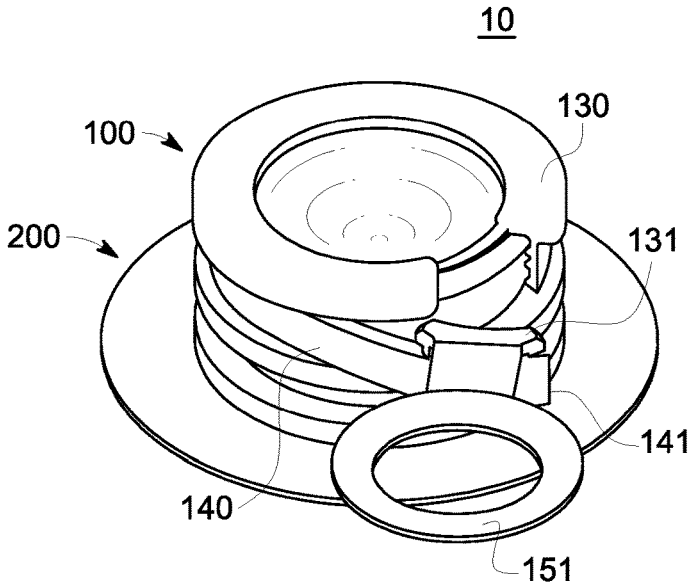
FIG. 8 is a perspective view of a closure assembly, with pull-tab in a deployed position, secured upon spout 200 with retaining skirt partially pulled away from connecting flange, in accordance with at least one embodiment of the invention.
Figure 9:
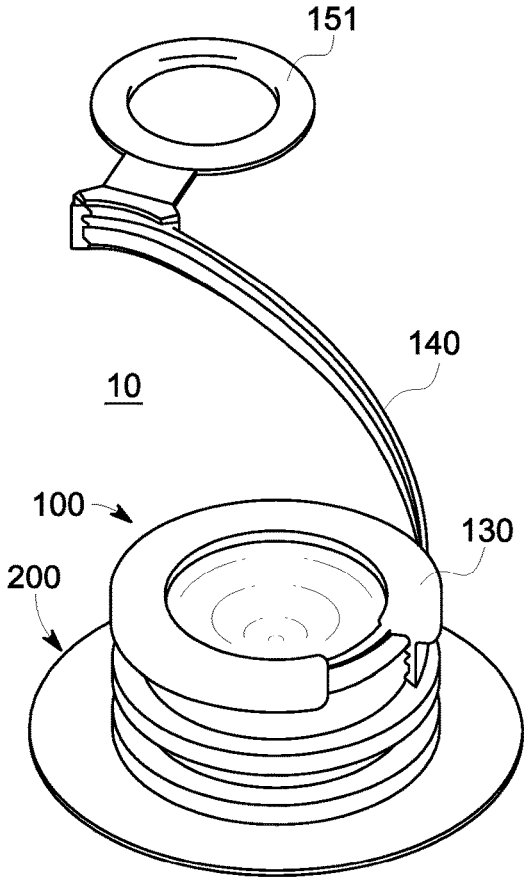
FIG. 9 is a further perspective view of a closure assembly, with pull-tab in a deployed position, with retaining skirt further pulled away from connecting flange, in accordance with at least one embodiment of the invention.
Figure 10:
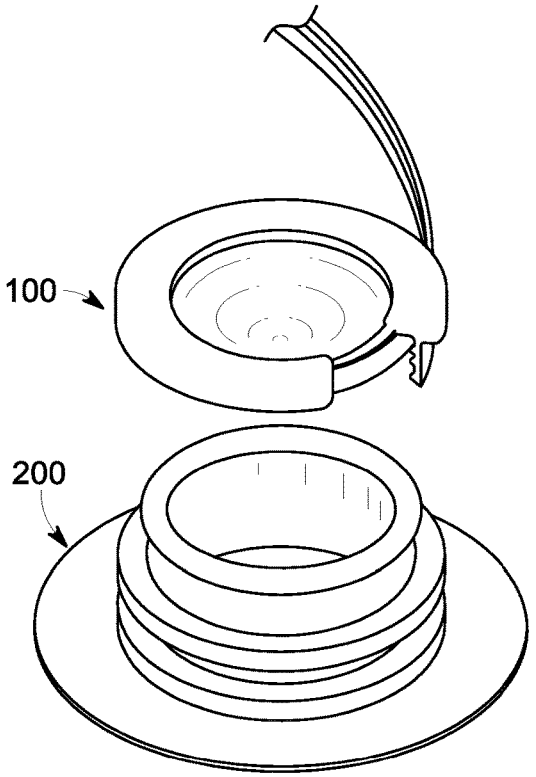
FIG. 10 is a perspective view of a closure assembly removed from the spout, in accordance with at least one embodiment of the invention.

FIGS. 7-10 are sequential perspective views showing a process for removing the closure assembly 100 from the spout 200. FIG. 7 is a perspective view of a portion of the closure assembly 10 showing a tear initiation point 175 in the cap collar 120. FIG. 8 is a perspective view of a closure assembly 100, with pull-tab 151 in a deployed position, secured upon spout 200 with retaining skirt 140 partially pulled away from connecting flange 130, in accordance with at least one embodiment of the invention. FIG. 9 is a further perspective view of a closure assembly 100, with pull-tab 151 in a deployed position, with retaining skirt 140 further pulled away from connecting flange 130, in accordance with at least one embodiment of the invention. FIG. 10 is a perspective view of a closure assembly 100 removed from spout 200, in accordance with at least one embodiment of the invention.

Figure 11:
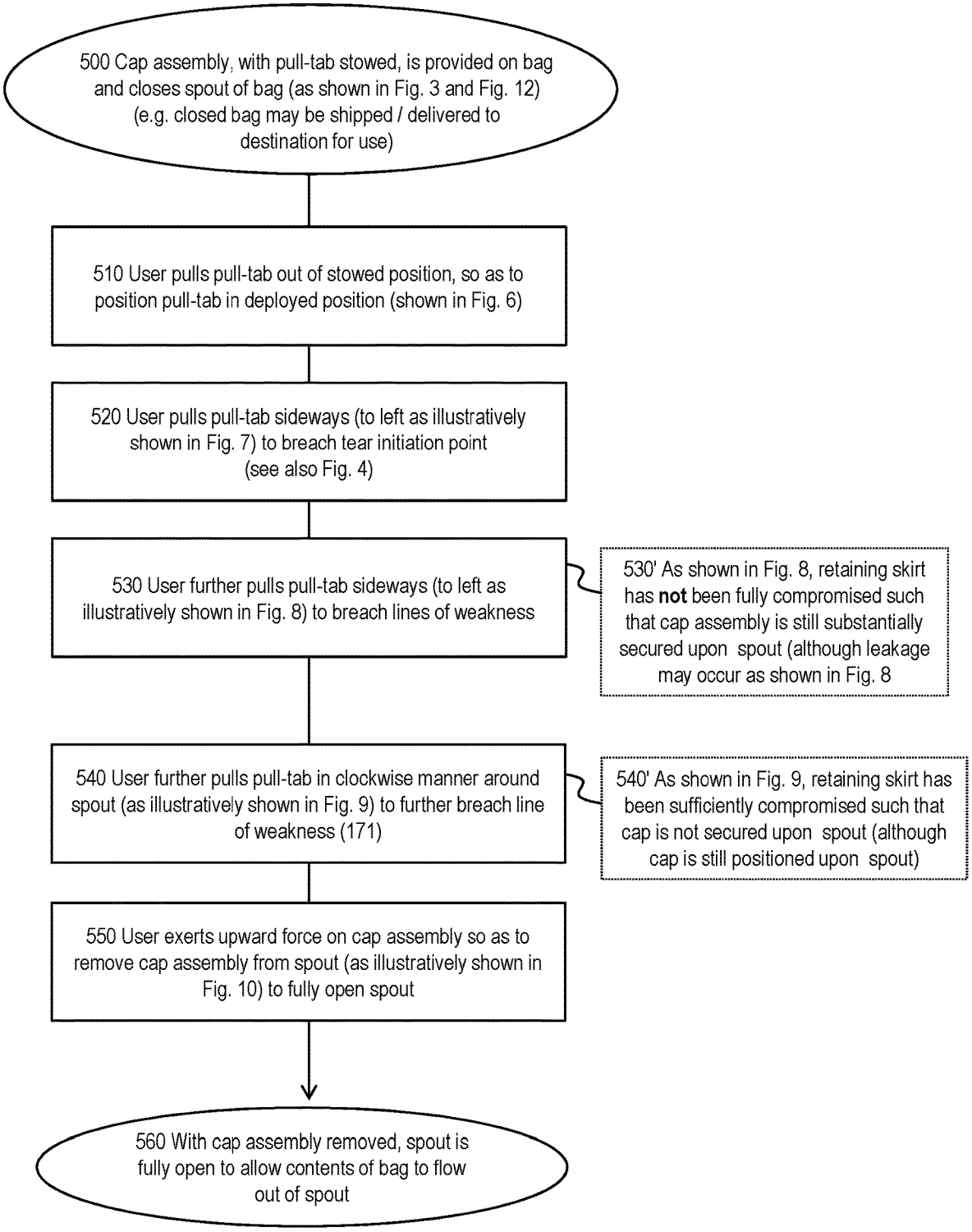
FIG. 11 is a flow chart showing a process to remove a closure assembly from a spout, in accordance with at least one embodiment of the invention.

FIG. 11 is a flow chart showing a process for removing a closure assembly 100 from a spout 200, in accordance with at least one embodiment of the invention. The process starts with step 500. In step 500, the closure assembly 100, with the pull-tab stowed, is provided on a bag, such as bag 700 shown in FIG. 12. The closure assembly 100 serves to close spout 200 and to contain fluid within bag 700. In the closed position, the bag may be shipped or delivered to a desired destination and/or handled in any other way as required. After step 500 as shown in FIG. 11, the process passes to step 510.

Figure 12:
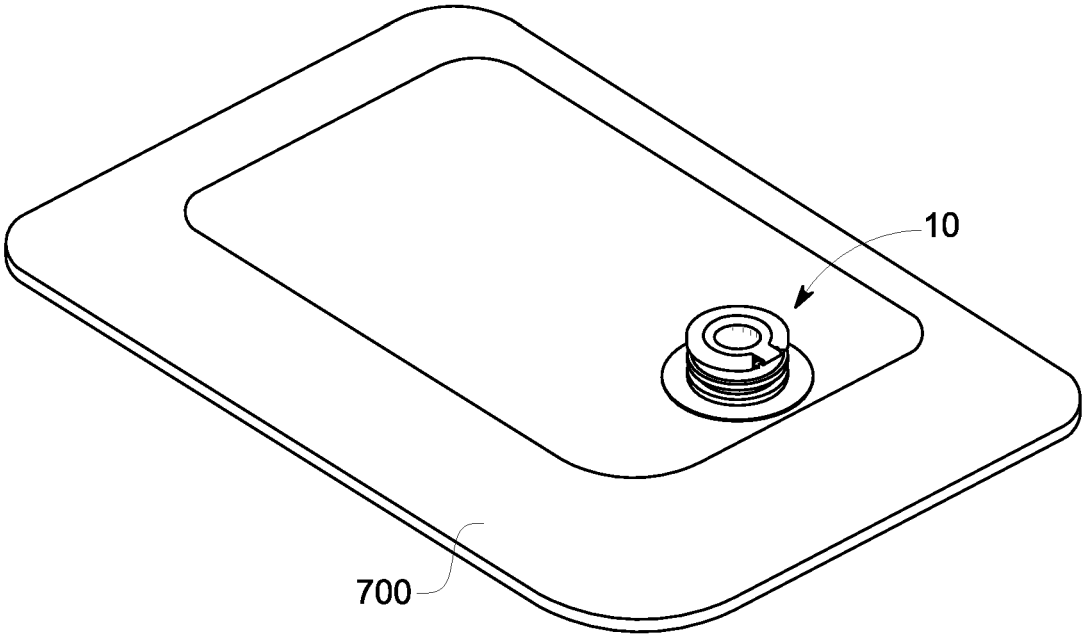
FIG. 12 is a perspective view of a closure assembly disposed upon bag, in accordance with at least one embodiment of the invention.

FIG. 12 is a perspective view of a closure assembly 10 disposed upon bag 700, in accordance with at least one embodiment of the invention.

In step 510, a user engages pull-tab 151 with his or her finger, for example, so as to pull pull-tab 151 out of the stowed position as shown in FIG. 3. That is, a user pulls the pull-tab so as to position the pull-tab in a deployed position as shown in FIG. 6. After step 510, the process passes to step 520.

In step 520, the user pulls the pull-tab sideways and/or in other direction, i.e. to the left as shown in FIG. 7. Accordingly, the user exerts a pull force that may be exerted upwards, downwards, and/or to the left as shown in FIG. 7. This pull force exerts a force upon tear initiation point 175 and/or other lines of weakness of the closure assembly 100. Accordingly, separation of the connecting flange tear segment 131 from the remaining portion of the connecting flange 130 is initiated. After step 520, the process passes to step 530.

In step 530, the user further pulls the pull-tab sideways to the left as shown in FIG. 8. The exertion of such pull force serves to rupture or breach various lines of weakness including lines 176, 174, 173, 172 and/or 171. As a result, in the arrangement shown in FIG. 8, the connecting flange tear segment 131 is completely separated from the remaining portion of the connecting flange. The retaining skirt 140 is separated partially from the spout retaining collar 211. In the arrangement of FIG. 8, as reflected at 530' of FIG. 11, the retaining skirt 540 has not been fully compromised such that the closure assembly 100 is still substantially secured upon the spout 200. Although, it is appreciated that in the arrangement of FIG. 8, the closure assembly 10 has been compromised to sufficient degree such that leakage might occur through spout opening 220. After step 530 of FIG. 11, process passes to step 540.

In step 540, the user further exerts a pull force and pulls the pull-tab in a clockwise manner around the spout 200, as is shown in FIG. 9. Such exertion of further pull force results in further breach or rupture line of weakness 171, as shown in FIG. 5. It is appreciated that as retaining skirt 140 is further segregated, a long line of weakness 171, the closure assembly 100 will be progressively less secured to the spout 200.

After step 540 of FIG. 11, the process passes to step 550. In step 550, the user exerts an upward force on the closure assembly 100 so as to remove the closure assembly 100 from the spout 200. This results in access to spout opening 220 and a fully opened disposition of the spout 200/bag 700. Accordingly, as reflected in step 560, with the closure assembly 100 is removed, the spout is fully open to allow contents of bag 700 to flow out of the spout 200.

The various components described herein may be made from any of a variety of materials including, for example, plastic, plastic resin such as polyethylene, polypropylene, nylon, composite material, foam and/or rubber, for example, or any other material as may be desired. For example, the closure assembly and/or the spout described herein may be produced from a plastic resin, such as polyethylene, and by injection moulding. However, it is appreciated that safe material consideration should be considered in the case that the closure assembly is to be used with a consumable. The apparatus of the disclosure, as described herein, is used in the context of a bag or container that contains a liquid. However, the apparatus of the disclosure may be used in conjunction with other substances, such as vapor or solid, such as granulized solid, for example.

A variety of production techniques may be used to make the apparatuses described herein. For example, suitable injection moulding and other moulding techniques and other manufacturing techniques might be utilised. Also, the various components of the apparatuses may be integrally formed, as may be desired, in particular when using moulding construction techniques. Also, the various components of the apparatuses may be formed in pieces and connected together in some manner, such as with a suitable adhesive acceptable for the intended use. The various lines of weakness, as described herein, may either be moulded into the particular part, cut in post moulding, or stamped in post moulding, for example. It is appreciated that a tear initiation point may be at an alternate point along a line of weakness, and is not limited to the particular arrangement shown in FIG. 7, for example.

Fastener arrangements, such as those needed to connect the spout securement collar to a supporting bag, used in the invention might include welding, compression fit, D-zip, tape and/or adhesive, for example. Suitable faster arrangements acceptable for the intended use (for example to comply with regulations such as food standards or that are fit for the intended purpose) will be well known to persons skilled in the art. Thus, such persons may select between alternative fastener arrangements, as required.

The various apparatuses and components of the apparatuses, as described herein, may be provided in various sizes and/or dimensions, as desired. Suitable sizes and/or dimensions will vary depending on the specifications of connecting components or the field of use, which may be selected by persons skilled in the art.

It will be appreciated that features, elements and/or characteristics described with respect to one embodiment of the disclosure may be used with other embodiments of the invention, as desired.

Although the preferred embodiments of the present invention have been disclosed for illustrative purposes, those skilled in the art will appreciate that various modifications, additions and substitutions are possible, without departing from the scope and spirit of the disclosure and accompanying claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper", "top", "bottom", "left", "right" and the like, may be used herein for ease of description to describe the relationship of one element or feature to another element(s) or feature(s) as illustrated in the figures. It will be understood that spatially relative terms are intended to encompass different orientations of structures in use or operation, in addition to the orientation depicted in the drawing figures. For example, if a device in the drawing figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein should be interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to diagrams and/or cross-section illustrations, for example, that are schematic illustrations of preferred embodiments (and intermediate structures) of the description. As such, variations from the shapes of the illustrations as a result, for example, of manufacturing techniques and/or tolerances, are to be expected. Thus, embodiments of the description should not be construed as limited to the particular shapes of components illustrated herein but are to include deviations in shapes that result, for example, from manufacturing.

Unless otherwise defined, all terms (including technical and scientific terms) used herein have the same meaning as commonly understood by one of ordinary skill in the art to which this description belongs. It will be further understood that terms, such as those defined in commonly used dictionaries, should be interpreted as having a meaning that is consistent with their meaning in the context of the relevant art and will not be interpreted in an idealised or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the description. The appearances of such phrases in various places in the specification are not necessarily all referring to the same embodiment. Further, when a particular feature, structure, or characteristic is described in connection with any embodiment, it is within the purview of one skilled in the art to effect and/or use such feature, structure, or characteristic in connection with other ones of the embodiments.

Embodiments are also intended to include or otherwise cover methods of using and methods of manufacturing any or all of the elements disclosed above.

While the invention has been described above in terms of specific embodiments, it is to be understood that the invention is not limited to these disclosed embodiments. Upon reading the teachings of this disclosure many modifications and other embodiments of the invention will come to the mind of those skilled in the art to which this invention pertains, and which are intended to be and are covered by both this disclosure and the appended claims.

All publications mentioned in this specification are herein incorporated by reference. Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed in Australia or elsewhere before the priority date of each claim of this application.

It is indeed intended that the scope of the invention should be determined by proper interpretation and construction of the appended claims and their legal equivalents, as understood by those skilled in the art relying upon the disclosure in this specification and the attached drawings.

The invention claimed is:

1. A closure assembly for closing an opening defined by a spout provided on a flexible container comprising:

a capping member for covering the opening and further comprising a curved plugging portion extending outwardly at its outermost periphery forming a surface for the attachment of a substantially fracturable retaining skirt, the substantially fracturable retaining skirt being disposed about at least a portion of the periphery of the plugging portion and being attached to and projecting substantially perpendicularly from the surface and substantially parallel with the lengthwise orientation of the curved plugging portion, the substantially fracturable retaining skirt comprising a substantially annular securement means configured to grip at least a Portion of an exterior surface of the spout defining an opening on the flexible container, the substantially annular securement means comprising one or more annular ridges projecting inwardly from the substantially fracturable retaining skirt to abut against at least a portion of the exterior surface of the spout defining an opening on a flexible container, or grip at least a portion of a lip provided on the exterior surface of the spout, the substantially fracturable retaining skirt comprising a tear end and an attachment end at opposing ends of the substantially fracturable retaining skirt, the tear end having a grip means attached thereto and a weakening at the area of attachment of the substantially fracturable retaining skirt to a surface of the curved plugging portion, and the attachment end having a substantially secure attachment at the area of attachment of the substantially fracturable retaining skirt to the surface of the curved plugging portion;

wherein the substantially fracturable retaining skirt is configured to be fracturable upon application of force from the grip means away from the curved plugging portion but the attachment end of the substantially fracturable retaining skirt is configured to be non-fracturable, and the application of force at the attachment end permits the release of the curved plugging portion.

2. The closure assembly according to claim 1 wherein the curved plugging portion is curved about a substantially central axis.

3. The closure assembly according to claim 2 wherein the curved plugging portion is further characterised by a hollow semi dome shape, the convexity of the curved plugging portion extending downwardly, and a substantially annular projection extending outwardly from an edge of the curved plugging portion to provide a surface for the attachment of the substantially fracturable retaining skirt.

4. The closure assembly according to claim 1 wherein the curved plugging portion is configured to abut against an inner wall of the spout defining an opening on a flexible container to plug the opening and substantially enclose the contents of the flexible container therein.

5. The closure assembly according to claim 1 wherein the attachment of the substantially fracturable retaining skirt to the surface of the curved plugging portion is weakened by a reduction in the thickness of a material forming the closure assembly at the area of attachment of the substantially fracturable retaining skirt to the surface of the curved plugging portion, but not at the area of attachment of the attachment end of the retaining skirt.

6. The closure assembly according to claim 5 wherein the area of attachment of the substantially fracturable retaining skirt to the surface of the curved plugging portion comprises a notch at the tear end to aid the tearing of the substantially fracturable retaining skirt and unplugging of the curved plugging portion.

7. The closure assembly according to claim 6 wherein the grip means comprises a hook or annular ring to aid the gripping of the grip means by a user and the application of force on the grip means away from the curved plugging portion by the user.

8. The closure assembly according to claim 7 wherein the grip means comprises an annular ring attached to the tear end of the substantially fracturable retaining skirt extending outwardly from the substantially fracturable retaining skirt.

9. A method of manufacture of the closure assembly according to claim 1 wherein the closure assembly is moulded from a plastic or plastic composite material and a weakening between the substantially fracturable retaining skirt and the surface of the curved plugging portion is formed by moulding the weakening into the closure assembly, by cutting the weakening into the closure assembly or by stamping the weakening into the closure assembly formed by moulding.

10. A method of closing the opening defined by the spout provided on the flexible container comprising positioning the curved plugging portion of a closure assembly according to claim 1 over the opening and engaging the substantially fracturable retaining skirt about at least a portion of an exterior surface of the spout.

* * * * *